US009557144B2

(12) United States Patent
Strum

(10) Patent No.: US 9,557,144 B2
(45) Date of Patent: Jan. 31, 2017

(54) VERSATILE PROTECTIVE HELMET APPLIQUE ASSEMBLY

(71) Applicant: Velocity Systems LLC, Dulles, VA (US)

(72) Inventor: David B. Strum, Amissville, VA (US)

(73) Assignee: Velocity Systems LLC, Dulles, VA (US)

( * ) Notice: Subject to any disclaimer, the term of this patent is extended or adjusted under 35 U.S.C. 154(b) by 420 days.

(21) Appl. No.: 13/912,720

(22) Filed: Jun. 7, 2013

(65) Prior Publication Data

US 2014/0359911 A1 Dec. 11, 2014

Related U.S. Application Data

(63) Continuation-in-part of application No. 13/594,964, filed on Aug. 27, 2012, now Pat. No. 9,222,758.
(Continued)

(51) Int. Cl.
*A42B 3/04* (2006.01)
*F41H 1/04* (2006.01)
*A42B 3/00* (2006.01)

(52) U.S. Cl.
CPC *F41H 1/04* (2013.01); *A42B 3/003* (2013.01)

(58) Field of Classification Search
CPC ..... F41H 1/04; F41H 1/06; F41H 1/08; F41H 5/013; A42B 3/003; A42B 3/063; A42B 3/069; A42B 3/124; A42B 3/125; A42B 3/127; A42B 3/128
See application file for complete search history.

(56) References Cited

U.S. PATENT DOCUMENTS 3,582,990 A 6/1971 Frieder et al.
4,023,209 A 5/1977 Frieder et al.
(Continued)

FOREIGN PATENT DOCUMENTS

DE 100 28 849 12/2001
JP 2002294512 10/2002
WO 2010149878 12/2010

OTHER PUBLICATIONS

Office Action for U.S. Appl. No. 13/594,964, dated Dec. 10, 2014.
(Continued)

*Primary Examiner* — Khaled Annis
(74) *Attorney, Agent, or Firm* — Williams Mullen, PC; Thomas F. Bergert

(57) ABSTRACT

The helmet appliqué assembly of the present invention permits a helmet wearer to upgrade the ballistic prevention capabilities of a traditional helmet quickly and efficiently. The helmet appliqué can be provided as part of a helmet appliqué system and/or assembly that includes internal-side connection means for attaching to a helmet and external-side connection means for receiving any of various external items such as identification tags, mounts and external equipment or attachments. The appliqué element can comprise various types of material, including, for example, ultra high molecular weight polyethylene (UHMWPE). In one embodiment of the present invention, multiple helmet appliqué elements are employed on the same helmet and include surfaces and portions that are cooperatively engageable for covering multiple areas of the helmet at the same time.

11 Claims, 7 Drawing Sheets

Related U.S. Application Data

(60) Provisional application No. 61/527,671, filed on Aug. 26, 2011.

(56) References Cited

U.S. PATENT DOCUMENTS

| | | | | | |
|---|---|---|---|---|---|
| 4,908,877 | A * | 3/1990 | White | A42B 3/063 | 2/412 |
| 4,996,724 | A * | 3/1991 | Dextrase | A42B 3/066 | 2/411 |
| 5,056,162 | A * | 10/1991 | Tirums | A42B 3/125 | 2/412 |
| 5,309,576 | A * | 5/1994 | Broersma | A42B 3/128 | 2/412 |
| 6,026,510 | A | 2/2000 | Kocher | | |
| 6,243,881 | B1 * | 6/2001 | Brinkman | A42B 3/003 | 2/411 |
| 6,272,692 | B1 * | 8/2001 | Abraham | A42B 3/063 | 2/411 |
| 6,324,700 | B1 * | 12/2001 | McDougall | A42B 3/324 | 2/414 |
| 6,363,539 | B2 | 4/2002 | Tachi et al. | | |
| 6,804,829 | B2 | 10/2004 | Crye et al. | | |
| 7,805,776 | B2 | 10/2010 | Crossman et al. | | |
| 8,020,220 | B2 | 9/2011 | McElroy et al. | | |
| 8,166,573 | B1 | 5/2012 | Chung et al. | | |
| 8,613,114 | B1 * | 12/2013 | Olivares Velasco | A42B 3/125 | 2/171 |
| 8,776,272 | B1 | 7/2014 | Straus et al. | | |
| 2001/0004773 | A1 * | 6/2001 | Moore | A42B 3/003 | 2/425 |
| 2004/0060100 | A1 | 4/2004 | Reiterman | | |
| 2006/0248623 | A1 | 11/2006 | Miller | | |
| 2007/0130672 | A1 * | 6/2007 | Beddoe | A42B 3/125 | 2/410 |
| 2007/0157370 | A1 * | 7/2007 | Ouches | Joubert Des A42B 3/324 | 2/410 |
| 2009/0313736 | A1 | 12/2009 | Kocher et al. | | |
| 2010/0275337 | A1 | 11/2010 | Bhatnagar et al. | | |
| 2011/0055993 | A1 | 3/2011 | Baudou et al. | | |
| 2011/0083240 | A1 | 4/2011 | Crye et al. | | |
| 2011/0099675 | A1 | 5/2011 | Parks et al. | | |
| 2011/0203024 | A1 * | 8/2011 | Morgan | F41H 1/04 | 2/2.5 |
| 2011/0205731 | A1 | 8/2011 | O'Keefe et al. | | |
| 2012/0011631 | A1 | 1/2012 | Crossman et al. | | |
| 2013/0031700 | A1 | 2/2013 | Wacter et al. | | |
| 2013/0047309 | A1 | 2/2013 | Strum | | |

OTHER PUBLICATIONS

Office Action for U.S. Appl. No. 13/594,964, USPTO, dated Aug. 17, 2015.

International Search Report and Written Opinion for PCT/US2013/056603, USPTO, Aug. 26, 2013.

* cited by examiner

VERSATILE PROTECTIVE HELMET APPLIQUE ASSEMBLY

CROSS-REFERENCE TO RELATED APPLICATIONS

The present application is a continuation-in-part application of U.S. patent application Ser. No. 13/594,964, filed Aug. 27, 2012, and entitled "Versatile Protective Helmet appliqué Assembly."

FIELD OF THE INVENTION

The present invention pertains to armor-enhanced headwear, and more particularly to an armor-enhanced helmet appliqué assembly including a helmet appliqué that is comfortable, balanced, detachable, versatile and which protects the head from projectiles such as ballistic projections.

BACKGROUND AND SUMMARY OF THE INVENTION

Military and law enforcement personnel have employed armor-enhanced clothing in order to protect their bodies from gunfire, shrapnel, explosive devices and other harmful ballistic objects. Such personnel have further employed armor-enhanced helmets in an effort to block ballistic objects from penetrating traditional helmets and producing injury or grave damage to the head of the wearer. However, prior armor-enhanced helmets are typically heavy and awkward to wear, often causing undue neck fatigue and even injury to the wearer.

The present invention provides a helmet appliqué assembly including a helmet appliqué that is lighter weight, and attachable to an existing helmet to cover one or more areas of an otherwise exposed helmet. The appliqué element of the present invention can be suitably relieved in areas where no ballistic protection is required, or where ballistic protection would otherwise impede certain functions of the helmet and the wearer's desired functional capabilities. The appliqué element of the present invention can comprise various types of material, including, for example, ultra high molecular weight polyethylene (UHMWPE), aramid fibers, ceramics, polycarbonate, steel or a combination of two or more such materials. The appliqué assembly of the present invention further includes one or more underside attachment member types for attaching the appliqué to a helmet, and can optionally include one or more external-side attachment or connector members for attaching other articles to the outside of the appliqué element. Accordingly, the appliqué system and/or assembly of the present invention increases the protection level of a helmet in a specific area or areas as a mission or threat dictates by allowing the appliqué element to be donned or doffed as needed, and thereby does not require the additional weight of the appliqué element to be permanent.

DETAILED DESCRIPTION OF EMBODIMENTS OF THE PRESENT INVENTION

Figure 1:
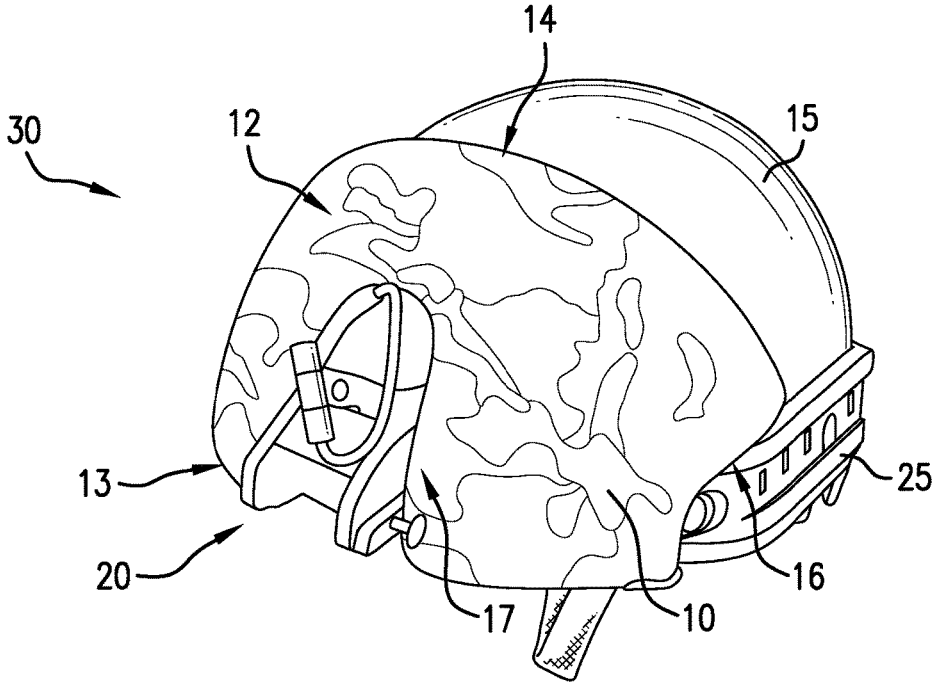
FIG. 1 is a top right perspective view of one embodiment of the appliqué assembly of the present invention in position on a helmet.

As shown in FIG. 1, one embodiment of the helmet appliqué assembly 30 of the present invention includes a helmet appliqué element 10 attached to an underlying helmet 15. The helmet 15 can be provided with various attachments such as a night vision device mount 20 and a rail system 25. The rail system permits the helmet to attach necessary or desirable articles such as lighting, camera or other accessories as is known in the art. The appliqué element 10 is formed and shaped so as to avoid impeding the use and functionality of the night vision device mount 20 and rail system 25, and can further be designed in alternative embodiments to extend further or less in a given direction depending upon the specific underlying helmet involved.

In the embodiment shown in FIG. 1, the ballistic appliqué element 10 of the present invention includes an external surface 12 and an internal surface in between the element 10 and the helmet 15, a front profile edge 13, a rear profile edge 14 and two side profile edges 16, wherein the side profile edges are curved so as to provide relief around edge attachments 25 of the helmet. The front profile edge 13 can be formed so as to provide an opening 17 in a variety of shapes, such as rectangular, square and/or U-shaped. In the embodiment shown in FIG. 1, the front profile edge 13 is formed so as to provide a substantially U-shaped opening 17 in the appliqué element. The appliqué element 10 can comprise ballistic material hermetically sealed and encapsulated within a fabric material, wherein the ballistic material comprises one or more of: ultra-high molecular weight polyethylene, aramid fibers, ceramics, polycarbonate material, and/or steel as described above.

In one embodiment of the present invention, the helmet appliqué assembly 30 further includes one or more connector members secured to the internal surface of the appliqué element 10, with the connector members being capable of secure engagement with one or more counterpart connector members of the helmet 15. For instance, hook-and-loop type fasteners, straps, snaps and other similar attachment means can be employed. It will be appreciated that the fastener elements can be directly secured to the fabric material described above.

Figure 2:
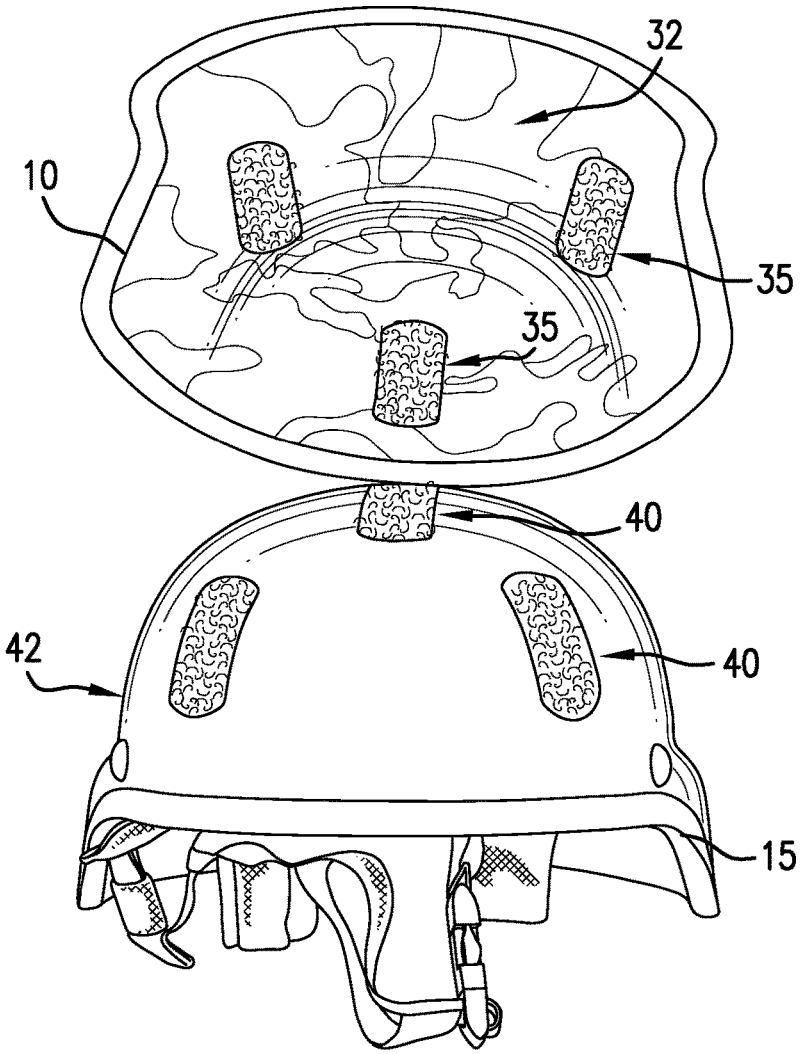
FIGS. 2 and 3 are front views of photographs of the appliqué assembly of the present invention as removed from a secured position on a helmet.
Figure 3:
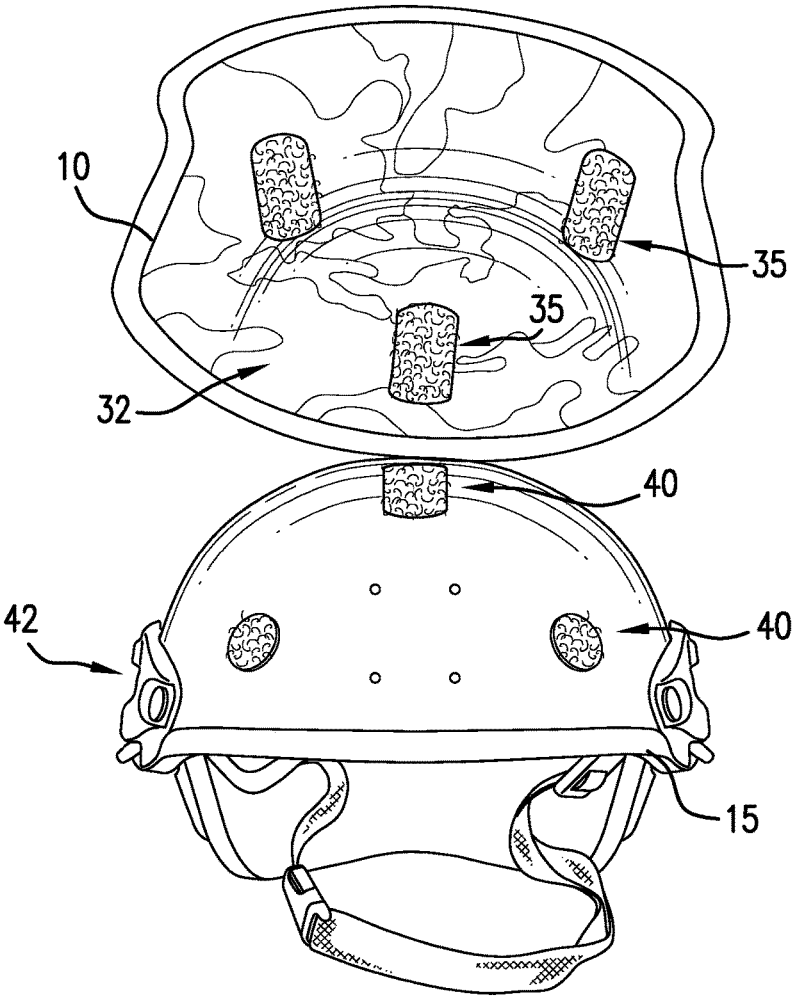

In a specific embodiment, a hook or loop fastener strip, with adhesive on one side and hook or loop fasteners on the other, is adhered to the internal surface of the appliqué element 10, such that the adhesive side is pressed against the internal surface of the appliqué element and the hook or loop side faces outwardly. A counterpart loop or hook strip can be similarly applied to an underlying helmet (such as helmet 15) in order to be able to securely retain the strip affixed to the internal surface of the appliqué element. It will be appreciated that multiple hook or loop strips can be secured to the internal surface of the appliqué element in locations deemed most suitable to create a secure but releasable fit with the underlying helmet. Such an arrangement is illustrated in the embodiments of the present invention shown in FIGS. 2 and 3, wherein the helmet appliqué element 10 includes fasteners 35 secured to the internal surface 32 thereof, and these fasteners 35 are aligned so as to mate with counter fastener elements 40 on the exterior surface 42 of helmet 15. When element 10 is desired to be donned, it can be attached to helmet 15 by aligning fasteners 35 with fasteners 40, and when element 10 is desired to be doffed, it can be lifted with sufficient pressure from helmet 15 in order to overcome the retention strength of the fasteners, thereby allowing element 10 to be removed.

As an alternative to hook or loop strips, the present invention can use other connector member types, such as male or female snap members secured to the internal surface of the appliqué element, and positioned so as to mate with the counterpart female or male snap members on the outer surface of the helmet. As a further alternative, the connector member types can comprise one or more straps that can be secured to the underlying helmet in known fashion.

In the embodiment of the present invention as shown in FIG. 1, the helmet appliqué element 10 is applied to the frontal lobe of the helmet. However, it will be appreciated that the helmet appliqué element 10 can cover different or additional areas of the helmet depending upon intended use and anticipated threat or mission. Further, it will be appreciated that multiple helmet appliqué elements can be employed on the same helmet when desirable.

Figure 4:
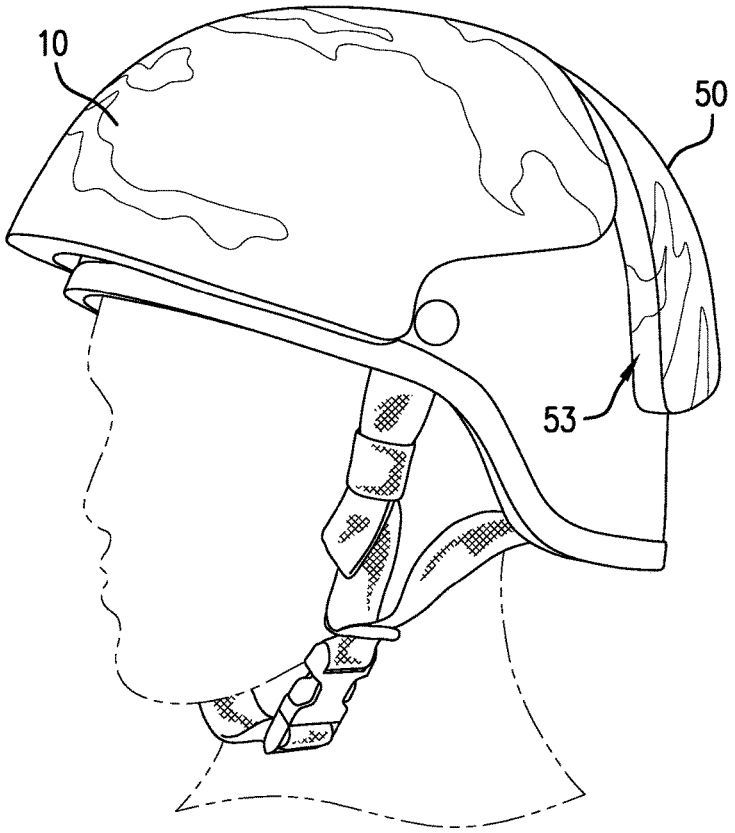
FIGS. 4 through 6 are photographs of additional embodiments of the appliqué assembly of the present invention in position on a helmet and mannequin.
Figure 5:
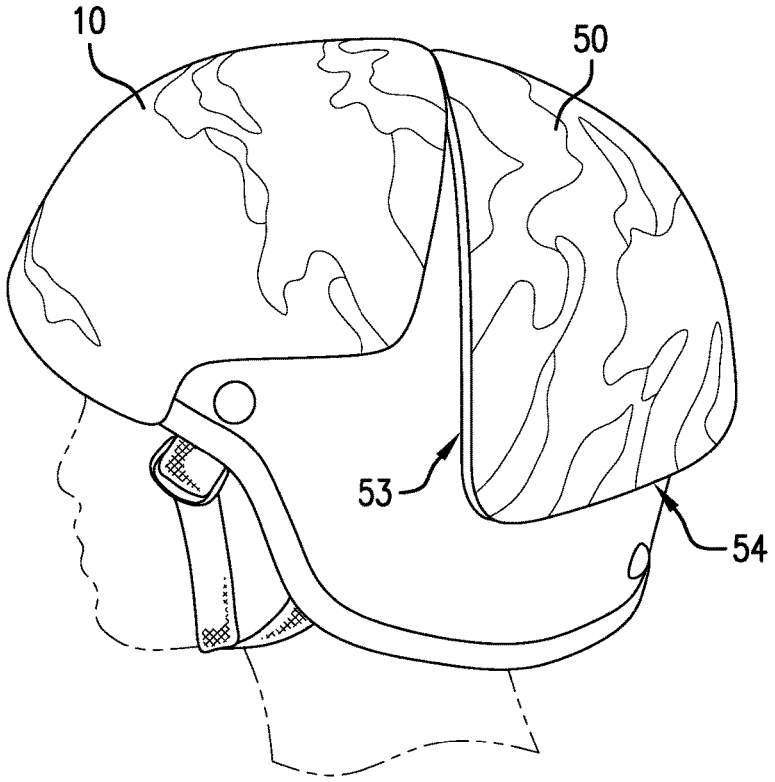
Figure 6:
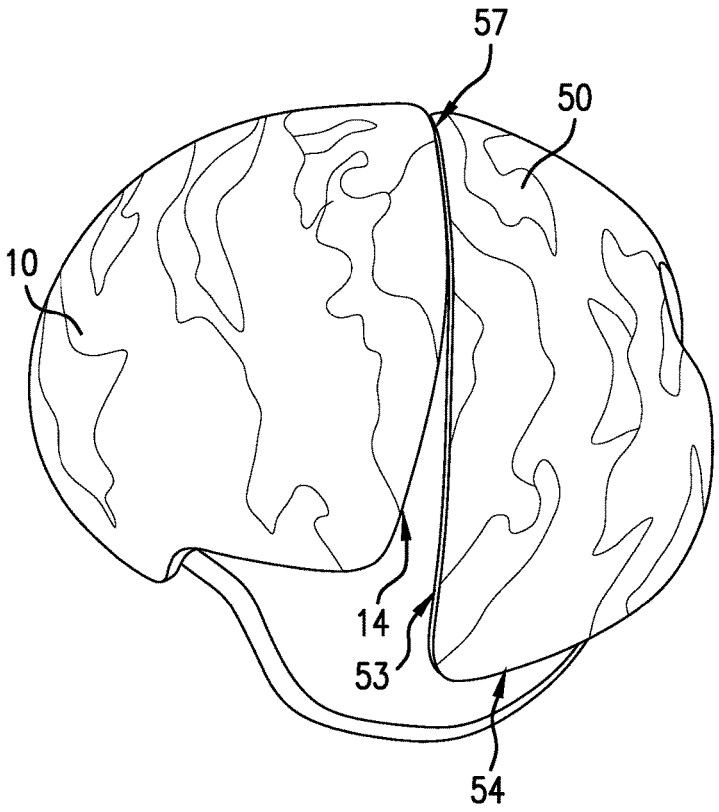
Figure 7:
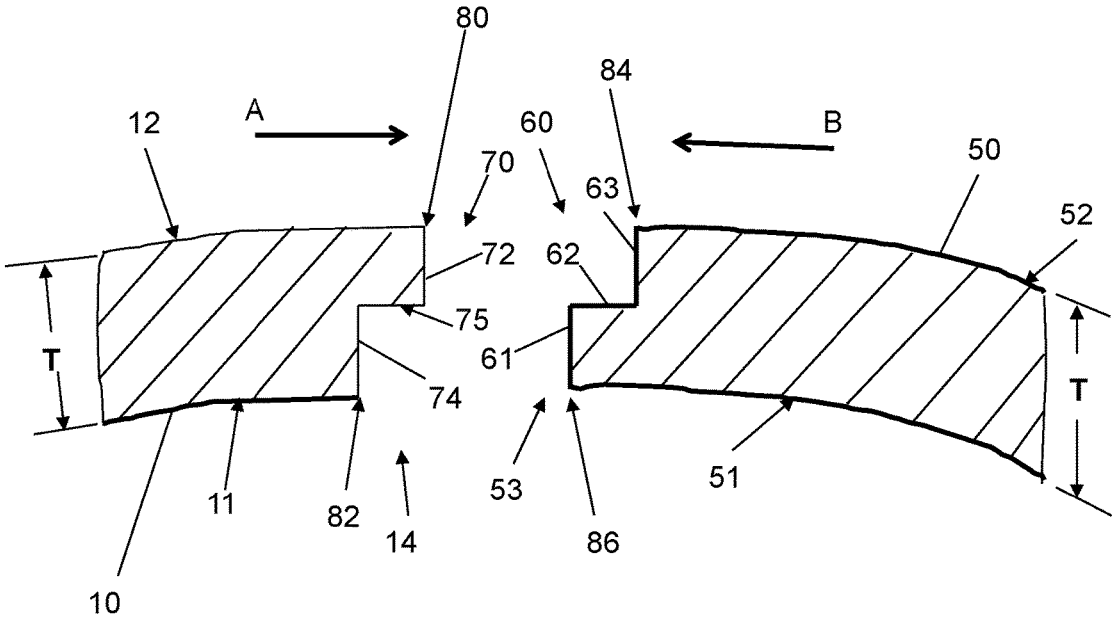
FIG. 7 is a partial cross-sectional view of mating elements in accordance with one embodiment of the helmet appliqué assembly of the present invention.

As shown in FIGS. 4-6, a separate helmet appliqué element 50 is shown for the back portion of a helmet. As with element 10, element 50 can comprise ballistic material hermetically sealed and encapsulated within a fabric material, wherein the ballistic material comprises one or more of: ultra-high molecular weight polyethylene, aramid fibers, ceramics, polycarbonate material, and/or steel as described above. The secondary element 50 has an external surface 52 and an internal surface (not shown) in between the element 50 and the helmet 15, a front profile edge 53 and a rear profile edge 54. In one embodiment of the invention, the rear profile edge 54 can be curved so as to provide relief around edge attachments 25 of the helmet. In one embodiment of the present invention, as shown in FIG. 6, for example, at least a portion of the rear profile edge 14 of element 10 can mate with at least a portion of the front profile edge 53 of element 50 to form a seam 57. It will be appreciated that the mating edges 14, 53 can be provided with cooperating connector elements in order to keep the elements 10, 50 securely connected. It will also be appreciated that elements 10 and 50 can be provided so as to maximize the mating engagement of the profile edge 14 of element 10 and the profile edge 53 of element 50, and thereby provide a longer seam 57, which ensures maximum protection of the helmet wearer. It will further be appreciated that the profiles or heights of the profile edges 14 and 53 can be substantially the same so as to provide an aerodynamic and smooth overall surface extending above the underlying helmet. As shown in the exemplary embodiment of FIG. 7, the height or thickness T of element 10 is shown from the internal surfaces to the external surfaces of respective elements 10, 50. As further shown in FIG. 7, the rear profile edge 14 of element 10 extends from a termination edge 80 of the external surface 12 to a termination edge 82 of the internal surface 11 of the first element 10, and the front profile edge 53 of element 50 extends from a termination edge 84 of the external surface to a termination edge 86 of the internal surface of element 50. As shown in the exemplary embodiment of FIG. 7, the distance along the rear profile edge 14 between the termination edge 80 of the external surface 12 and the termination edge 82 of the internal surface 11 of the first ballistic appliqué element 10 is larger than the first element thickness T. In FIG. 7, the exemplary rear profile edge 14 comprises first ledge drop surface 72, second ledge drop surface 74 and under-ledge surface 75. The distance along the front profile edge 53 between the termination edge 84 of the external surface 52 and the termination edge 86 of the internal surface 51 of the second ballistic appliqué element 50 is larger than the second element thickness T. In FIG. 7, the exemplary front profile edge 53 comprises first riser portion 61, front step portion 62 and second riser portion 63.

In one embodiment of the present invention, as illustrated in FIG. 7, the front profile edge 53 of element 50 can comprise a rampart member 60 having a first riser portion 61 extending upward from the internal surface 51 of element 50 to a front step portion 62, wherein the front step portion 62 is substantially curved in accordance with the curvature of the element 50 and the underlying helmet 15, and further wherein the front step portion 62 meets with a second riser portion 63, which extends to the external surface 52 of element 50. In one embodiment of the present invention, the first riser portion 61 and the second riser portion 63 are substantially parallel. In another embodiment of the present invention, one or more of the first riser portion 61, front step portion 62 and second riser portion 63 are provided with connector elements to facilitate connection with the element 10 of the present invention, when elements 10 and 50 are moved towards one another in the directions noted by arrows A and B.

Figure 8:
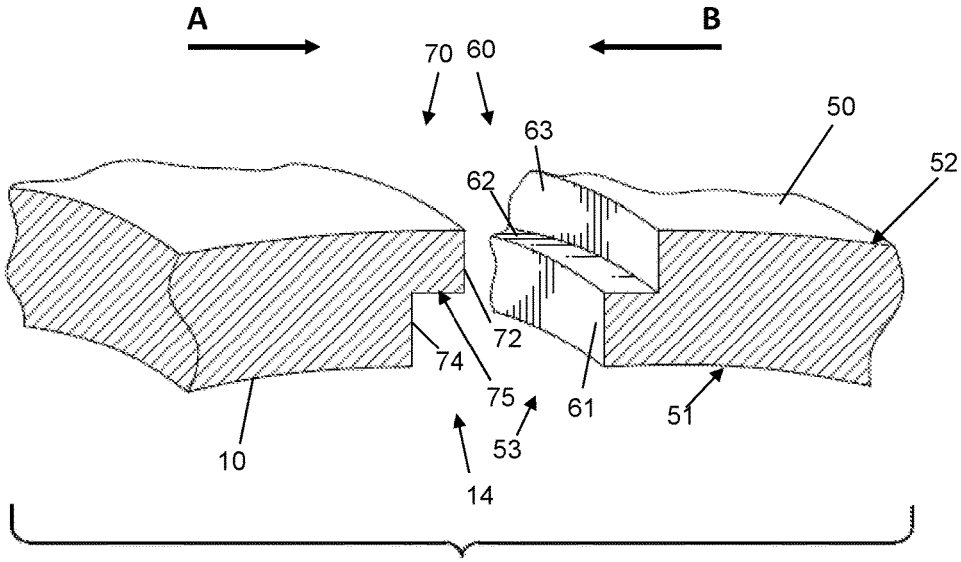
FIG. 8 is a partial cross-sectional perspective view of the mating elements shown in FIG. 7.

In connection with this embodiment of the present invention, which is also shown in FIG. 8, the helmet appliqué element 10 can be provided with a rear profile edge 14 having a ledge element 70 comprising a first ledge drop surface 72, a second ledge drop surface 74 and an under-ledge surface 75 extending from the first ledge drop surface 72 to the second ledge drop surface 74. In one embodiment of the present invention, the first ledge drop surface 72 and the second ledge drop surface 74 of the ledge element 70 are substantially parallel. The under-ledge surface 75 is substantially curved in accordance with the curvature of the front step portion 62 of the rampart member 60 of appliqué element 50. In this way, element 10 and element 50 can cooperatively engage atop the helmet 15, providing a snug, secure and protective fit for the wearer. It will be appreciated that one or more of the surfaces 72, 74 and 75 of the ledge element 70 can be provided with connector elements that cooperate with other connector elements provided on one or more portions 61, 62, 63 of the rampart member 60 of element 50 in order to keep the elements 10, 50 securely connected. In one embodiment of the present invention, the first riser portion is cooperatively engageable with the first ledge drop surface of the first element, the second riser portion is cooperatively engageable with the second ledge drop surface, and the front step portion is cooperatively engageable with the under-ledge drop surface. It will be appreciated that, while FIGS. 7 and 8 illustrate the rampart member 60 of element 50 extending from the lower portion of profile edge 53 and the ledge element 70 of element 10 extending from the upper portion of profile edge 14, the orientation can be reversed in accordance with an additional embodiment of the present invention. In such an additional embodiment, the rampart member 60 extends from the lower portion of profile edge 14 and the ledge element 70 extends from the upper portion of profile edge 53.

In one embodiment of the present invention, the respective internal and external surfaces of the first and second appliqué elements are in substantially flush relation when the front step portion of the rampart member of the second appliqué element is cooperatively engaged with the under-ledge drop surface of the ledge portion of the first appliqué element.

In one embodiment of the present invention, the helmet appliqué assembly 30 further includes one or more connector members secured to the internal surface of the appliqué element 10 and/or 50, with the connector members being capable of secure engagement with one or more counterpart connector members of the helmet 15. For instance, hook-and-loop type fasteners, straps, snaps and other similar attachment means can be employed. It will be appreciated that the fastener elements can be directly secured to the fabric material described above.

In one embodiment of the present invention, one or more connector members on the internal side of the appliqué element 10 and/or 50 are evenly distributed across the helmet appliqué so as to mate with appropriate mating attachment elements distributed across the helmet. In another embodiment of the present invention, the helmet appliqué element is provided as part of a helmet appliqué system kit or assembly, wherein the kit includes alternative attachment members for selection and use by the wearer or assembly personnel. Such an assembly can further include elements that can readily be secured to a helmet that may otherwise be incapable of receiving the helmet appliqué element of the present invention. For example, the kit can include strips of loop-type fasteners with an adhesive substance on one side and loop fasteners on the other, such that the adhesive side can be secured to the helmet, leaving the loop fasteners exposed and available for receiving mating hook fasteners secured to the underside of the helmet appliqué element. Similarly, such an assembly or kit can include one or more attachment components for attaching external elements to the external side of the appliqué element 10 and/or 50. For instance, a loop-type fastener strip with adhesive on one side can be secured to an identification tag via the adhesive side, and the loop-type fastener side can then be exposed for securing to a hook-type fastener on the external side of the appliqué element 10 and/or 50.

The appliqué element of the present invention can be quickly donned and doffed through the use of the attachment components of the present invention. When not in position on a helmet, one embodiment of the appliqué element 10 and/or 50 of the present invention is semi-rigid and can be stored in stand-alone or stacked fashion.

The present invention thus provides a helmet appliqué assembly including a helmet appliqué element that is lighter weight, and attachable to an existing helmet to cover one or more areas of an otherwise exposed helmet. As described above, the present invention can be suitably relieved in areas where no ballistic protection is required, or where ballistic protection would otherwise impede certain functions of the helmet and the wearer's desired functional capabilities. The appliqué element of the present invention can comprise various types of ballistic material, including, for example, ultra high molecular weight polyethylene (UHMWPE), aramid fibers, ceramics, polycarbonate, or a combination of two or more such materials. In one embodiment of the present invention, the appliqué element can be provided in form similar to a "soft armor" product, wherein the ballistic material is hermetically RF heat sealed and encapsulated within a fabric material (e.g., Cordura™) in order to maintain ballistic integrity in wet or sandy environments.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

The invention claimed is:

1. A helmet appliqué assembly, comprising:

a first ballistic appliqué element having an external surface with a curvilinear cross-section, an internal surface for engaging the outer surface of a helmet, wherein the internal surface has a curvilinear cross-section, and a first element profile edge, with the first element profile edge having a ledge element comprising a first ledge drop surface, a second ledge drop surface and an under-ledge surface extending from the first ledge drop surface to the second ledge drop surface; and a second ballistic appliqué element having an external surface with a curvilinear cross-section, an internal surface for engaging the outer surface of a helmet, wherein the internal surface has a curvilinear cross-section, and a second element profile edge, with the second element profile edge having a rampart member comprising a first riser portion, a second riser portion, and a front step portion extending from the first riser portion to the second riser portion, wherein the first riser portion is cooperatively engageable with the first ledge drop surface of the first element, the second riser portion is cooperatively engageable with the second ledge drop surface, and the front step portion is cooperatively engageable with the under-ledge drop surface.

2. The assembly of claim 1 wherein the first riser portion extends upwardly from the internal surface of the second element to the front step portion.

3. The assembly of claim 1 wherein the front step portion is substantially curved in accordance with the curvilinear cross-section of the external surface of the second element.

4. The assembly of claim 1 wherein the first riser portion and the second riser portion of the rampart member are substantially parallel.

5. The assembly of claim 1 wherein the under-ledge surface of the ledge element is substantially curved in accordance with the curvilinear cross-section of the internal surface of the first element.

6. The assembly of claim 1 wherein the first ledge drop surface and the second ledge drop surface of the ledge element are substantially parallel.

7. The assembly of claim 1 wherein the respective external surfaces of the first and second appliqué elements are in substantially flush relation when the front step portion of the rampart member of the second appliqué element is cooperatively engaged with the under-ledge drop surface of the ledge portion of the first appliqué element.

8. The assembly of claim 1 wherein the respective internal surfaces of the first and second appliqué elements are in substantially flush relation when the front step portion of the rampart member of the second appliqué element is cooperatively engaged with the under-ledge drop surface of the ledge portion of the first appliqué element.

9. A helmet appliqué assembly, comprising:

a first ballistic appliqué element having an external surface with a curvilinear cross-section, an internal surface for engaging the outer surface of a helmet, wherein the internal surface has a curvilinear cross-section, a first element thickness measured from the external surface to the internal surface, and a first element profile edge extending from a termination edge of the external surface to a termination edge of the internal surface of the first ballistic appliqué element, wherein the first element profile edge has a distance along the first element profile edge between the termination edge of the external surface and the termination edge of the internal surface of the first ballistic appliqué element that is larger than the first element thickness; and a second ballistic appliqué element having an external surface with a curvilinear cross-section, internal surface for engaging the outer surface of a helmet, wherein the internal surface has a curvilinear cross-section, a second element thickness measured from the external surface to the internal surface, and a second element profile edge extending from a termination edge of the external surface to a termination edge of the internal surface of the second ballistic appliqué element, wherein the second element profile edge has a distance along the second element profile edge between the termination edge of the external surface and the termination edge of the internal surface of the second ballistic appliqué element that is larger than the second element thickness, and wherein the first element profile edge and the second element profile edge are cooperatively engageable.

10. The assembly of claim 9 wherein the first element thickness and the second element thickness are substantially the same.

11. The assembly of claim 9 wherein the first element profile edge distance is substantially the same as the second element profile edge distance.

* * * * *